US007499658B2

(12) United States Patent
Kang et al.

(10) Patent No.: US 7,499,658 B2
(45) Date of Patent: Mar. 3, 2009

(54) IMAGE FORMING APPARATUS INCLUDING AT LEAST TWO THERMOSTATS TO PREVENT OVERHEATING OF THE HEATING ROLLER

(75) Inventors: Dong-ju Kang, Anyang-si (KR); Yong-whan Park, Suwon-si (KR); Kun-min Lim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 160 days.

(21) Appl. No.: 11/505,388

(22) Filed: Aug. 17, 2006

(65) Prior Publication Data

US 2007/0098418 A1 May 3, 2007

(30) Foreign Application Priority Data

Nov. 3, 2005 (KR) ..... 10-2005-0105069

(51) Int. Cl.
*G03G 15/20* (2006.01)

(52) U.S. Cl. ..... 399/33; 219/216; 399/69

(58) Field of Classification Search ..... 399/33, 399/67, 69, 320, 328, 334; 219/216, 494; 347/156

See application file for complete search history.

(56) References Cited

U.S. PATENT DOCUMENTS 3,755,770 A * 8/1973 Andersen ..... 337/354
6,097,904 A * 8/2000 Tsuruno et al. ..... 399/33
6,516,164 B1 * 2/2003 Kawazu ..... 399/69
6,816,688 B2 * 11/2004 Takano ..... 399/69
7,065,315 B2 * 6/2006 Kinouchi et al. ..... 399/334
7,199,335 B2 * 4/2007 Takami et al. ..... 219/216 X
2004/0240913 A1 * 12/2004 Tomatsu ..... 399/328
2005/0135820 A1 * 6/2005 Morihara et al. ..... 399/33
2005/0185977 A1 * 8/2005 Kamei ..... 399/69
2007/0077077 A1 * 4/2007 Jeong et al. ..... 399/33
2007/0140718 A1 * 6/2007 Mulder et al. ..... 399/69

FOREIGN PATENT DOCUMENTS

JP 58-162973 A * 9/1983

(Continued)

OTHER PUBLICATIONS

Office Action issued Nov. 15, 2006 by the Korean Intellectual Property Office re: Korean Patent Application No. 2005-105069 (2 pp).

*Primary Examiner*—Sophia S Chen
(74) *Attorney, Agent, or Firm*—Stein, McEwen & Bui, LLP

(57) ABSTRACT

An image forming apparatus, including a heat roller in which a heating source is embedded, a press roller installed close to the heat roller, the press roller contacting the heat roller with a predetermined pressurizing force to form a fixing nip, and at least two overheat prevention devices installed near the heat roller to cut off a power supply to the heating source upon an overheating of the heat roller. One of the overheat prevention devices is installed at portion of the heat roller corresponding to a location within a width of a recording medium passing through the fixing nip and another is installed at a site near an end of the heat roller corresponding to a location outside the width of the recording medium.

21 Claims, 9 Drawing Sheets

FOREIGN PATENT DOCUMENTS

| | | | | |
|---|---|---|---|---|
| JP | 07-92836 | | | 4/1995 |
| JP | 09-114317 | A | * | 5/1997 |
| JP | 2001-142542 | A | * | 5/2001 |
| JP | 2003-15463 | | | 1/2003 |
| JP | 2004-77345 | | | 3/2004 |
| JP | 2004-354514 | | | 12/2004 |
| JP | 2005-227769 | | | 8/2005 |

* cited by examiner

IMAGE FORMING APPARATUS INCLUDING AT LEAST TWO THERMOSTATS TO PREVENT OVERHEATING OF THE HEATING ROLLER

CROSS-REFERENCE TO RELATED APPLICATIONS

This application claims the benefit of Korean Application No. 2005-105069, filed Nov. 3, 2005, in the Korean Intellectual Property Office, the disclosure of which is incorporated herein by reference.

BACKGROUND OF THE INVENTION

1. Field of the Invention

Aspects of the present invention relate to an electrophotographic image forming apparatus such as a printer, copier and facsimile. More particularly, aspects of the present invention relate to an image forming apparatus having an enhanced sensor configuration to prevent an overheating of heating members.

2. Description of the Related Art

An image fixing apparatus of an electrophotographic image forming apparatus such as a printer, a copier and a facsimile comprises a heat roller containing a heating source, and a press roller installed adjacent to the heat roller that contacts the heat roller with a predetermined pressurizing force. That is, the image fixing apparatus is configured such that a recording medium having an unfixed toner image thereon is passed through a nip between the heat roller and press roller, thereby fixing the toner image on the recording medium with heat and pressure.

To prevent an overheating of the heat roller, the image fixing apparatus includes a thermostat installed, for example, near to the middle of the heat roller in the shaft direction. The thermostat stops an operation of the heating source by shutting off the power supply thereto when the heat roller is overheated.

An image fixing apparatus having the above-described thermostat has been disclosed in Japanese Patent Laid-Open Publication No. 2004-77345. In the image fixing apparatus disclosed in Japanese Patent Laid-Open Publication No. 2004-77345, a substance of low thermal conductivity is sandwiched between a first bimetal and a second bimetal so that the first bimetal and second bimetal bend together in the same direction in response to temperature changes to prevent a malfunction due to effects of overheating.

FIG. 1 is a schematic view showing a conventional image fixing apparatus. With reference to FIG. 1, the image fixing apparatus 1 includes a heat roller 15*a* embedding a heating source 15*c* such as a heat lamp and a press roller 15*b*. The heat roller 15*a* and press roller 15*b* tightly contact with each other due to an elastic force of a spring 15*f* and act to heat-compress a recording medium P passing between the two. A controller (not shown) controls an operation of the heating source 15*c* to maintain the surface temperature of the heat roller 15*a*, and permits the recording medium P to pass through a fixing nip N3 between the heat roller 15*a* having a constant temperature and press roller 15*b*, so as to fix a transferred image onto the recording medium P. A thermostat 15*e* installed near to the heat roller 15*a* shuts off the power supply to the heating source when the heating source 15*c* is overheated.

In an arrangement of the thermostat 15*e*, it is necessary to consider the width of a recording medium P passing through the fixing nip N3. That is, the surface temperature of a portion of the heat roller 15*a* within the width of a recording medium P may lower by about 10° C. than that of some other portion, outside of the width of the recording medium P, not contacting the recording medium P. This is due to the fact that, when recording medium P passes through the fixing nip N3 in succession, heat in the middle of the heat roller 15*a* is discharged through the passing recording medium R Conversely, heat at ends of the heat roller 15*a* may not be discharged, resulting in temperature differences.

Accordingly, it is necessary to arrange a thermostat corresponding to a temperature distribution pattern in the heat roller for more effective overheat prevention.

SUMMARY OF THE INVENTION

An aspect of the present invention is to solve at least the above and/or other problems and disadvantages and to provide at least the advantages described below. Accordingly, an aspect of the present invention is to provide an image forming apparatus wherein an effective overheat prevention mechanism is realized using different temperature properties corresponding to the width of a recording medium.

According to one aspect of the invention, there is provided an image forming apparatus comprising: a heat roller in which a heating source is embedded; a press roller installed close to the heat roller, the press roller contacting the heat roller with a predetermined pressurizing force to form a fixing nip; and at least two overheat prevention devices installed near the heat roller to cut off a power supply to the heating source upon an overheating of the heat roller, wherein the at least two overheat prevention devices operate at different temperatures. The different temperatures comprise a temperature of a surface of the heat roller.

According to an aspect of the invention, one of the overheat prevention devices is installed at a first site near to a portion of the heat roller corresponding to a location within a width of a minimum-sized recording medium passable through the fixing nip; and another is installed at a second site near to an end of the heat roller corresponding to another location outside a width of a maximum-sized recording medium passable through the fixing nip.

According to an aspect of the invention, gaps between the respective overheat prevention devices and a surface of the heat roller are set equal to one another, and response times of the respective overheat prevention devices are set different from one another.

According to an aspect of the invention, gaps between the respective overheat prevention devices and a surface of the heat roller are set different from one another, and operating temperatures of the respective overheat prevention devices are set equal to one another. The gap between the one overheat prevention device and the surface of the heat roller is narrower than that between another overheat prevention device and the surface of the heat roller.

According to an aspect of the invention, gaps between the respective overheat prevention devices and a surface of the heat roller are set different from one another, and response times of the respective overheat prevention devices are set equal to one another. The gap between the one overheat prevention device and the surface of the heat roller is narrower than that between another overheat prevention device and the surface of the heat roller.

In accordance with another aspect of the present invention, there is provided an image fixing apparatus comprising: a heat roller in which a heating source powered by a power supply is embedded; a press roller installed close to the heat roller, the press roller contacting the heat roller with a predetermined pressurizing force to form a fixing nip; at least one thermostat installed at a first site near a portion of the heat roller corresponding to a location within a width of a recording medium passing through the fixing nip and another thermostat installed at a second site near to an end of the heat roller corresponding to another location outside the width of the recording medium; overheat prevention devices, each associated with a corresponding thermostat, to cut off the power supply to the heating source upon a detection of an overheating of the heat roller by the thermostats.

According to an aspect of the invention, gaps between the respective thermostats and a surface of the heat roller are set equal to one another, and operating temperatures of the respective thermostats are set different from one another.

According to an aspect of the invention, the respective thermostats have the same type, and the operating temperatures of the one thermostat being an inner thermostat and the another thermostat being an outer thermostat are set different from each other owing to a difference between a thermal expansion coefficient of a bimetal in the inner thermostat and that of a bimetal in the outer thermostat.

According to an aspect of the invention, each of the thermostats is a closed-type, and comprises a housing, a bimetal installed in the housing so as to face the surface of the heat roller, an operating pin for contacting a surface of the bimetal, a guide plate to guide movement of the operating pin, a movable terminal coupled with the movement of the operating pin, a fixed terminal to selectively contact the movable terminal depending upon the movement of the operating pin, a power supply plate connectable with the movable terminal and fixed terminal, and a cap installed at an end of the housing facing the heat roller.

According to an aspect of the invention, each of the thermostats is an open-type, and comprises a housing, a bimetal installed in the housing so as to face the surface of the heat roller, an operating pin to contact a surface of the bimetal, a guide plate to guide movement of the operating pin, a movable terminal coupled with the movement of the operating pin, a fixed terminal to selectively contact the movable terminal depending upon the movement of the operating pin, and a power supply plate connectable with the movable terminal and fixed terminal.

According to an aspect of the invention, gaps between the respective thermostats and a surface of the heat roller are set equal to one another, and response times of the respective thermostats are set different from one another.

According to an aspect of the invention, the one thermostat being an inner thermostat is an open-type, and the inner thermostat comprises a housing, a bimetal installed in the housing so as to face the surface of the heat roller, an operating pin to contact a surface of the bimetal, a guide plate to guide movement of the operating pin, a movable terminal coupled with the movement of the operating pin, a fixed terminal to selectively contact the movable terminal depending upon the movement of the operating pin, and a power supply plate connectable with the movable terminal and fixed terminal; the another thermostat being an outer thermostat is a closed-type, and the outer thermostat comprises a housing, a bimetal installed in the housing so as to face the surface of the heat roller, an operating pin to contact a surface of the bimetal, a guide plate to guide movement of the operating pin, a movable terminal coupled with the movement of the operating pin, a fixed terminal to selectively contact the movable terminal depending upon the movement of the operating pin, a power supply plate connectable with the movable terminal and fixed terminal, and a cap installed at an end of the housing facing the heat roller; and the response times of the inner and outer thermostats are set different from each other.

According to an aspect of the invention, gaps between the respective thermostats and a surface of the heat roller are set different from one another, and response times of the respective thermostats are set equal to one another. At this time, it is preferable that the gap between the one thermostat being an inner thermostat and the surface of the heat roller is narrower than that between the other thermostat being an outer thermostat and the surface of the heat roller.

According to an aspect of the invention, each of the inner and outer thermostats is a closed-type, and comprises a housing, a bimetal installed in the housing so as to face the surface of the heat roller, an operating pin to contact a surface of the bimetal, a guide plate to guide movement of the operating pin, a movable terminal coupled with the movement of the operating pin, a fixed terminal to selectively contact the movable terminal depending upon the movement of the operating pin, a power supply plate connectable with the movable terminal and fixed terminal, and a cap installed at an end of the housing facing the heat roller.

According to an aspect of the invention, each of the inner and outer thermostats is an open-type, and comprises a housing, a bimetal installed in the housing so as to face the surface of the heat roller, an operating pin to contact a surface of the bimetal, a guide plate to guide movement of the operating pin, a movable terminal coupled with the movement of the operating pin, a fixed terminal to selectively contact the movable terminal depending upon the movement of the operating pin, and a power supply plate connectable with the movable terminal and fixed terminal.

According to an aspect of the invention, gaps between the respective thermostats and a surface of the heat roller are set different from one another, and operating temperatures of the respective thermostats are set equal to one another.

According to an aspect of the invention, the gap between the one thermostat being an inner thermostat and the surface of the heat roller is narrower than that between another thermostat being an outer thermostat and the surface of the heat roller.

According to an aspect of the invention, each of the inner and outer thermostats is a closed-type, and comprises a housing, a bimetal installed in the housing so as to face the surface of the heat roller, an operating pin to contact a surface of the bimetal, a guide plate to guide movement of the operating pin, a movable terminal coupled with the movement of the operating pin, a fixed terminal to selectively contact the movable terminal depending upon the movement of the operating pin, a power supply plate connectable with the movable terminal and fixed terminal, and a cap installed at an end of the housing facing the heat roller.

According to an aspect of the invention, each of the inner and outer thermostats is an open-type, and comprises a housing, a bimetal installed in the housing so as to face the surface of the heat roller, an operating pin to contact a surface of the bimetal, a guide plate to guide movement of the operating pin, a movable terminal coupled with the movement of the operating pin, a fixed terminal to selectively contact the movable terminal depending upon the movement of the operating pin, and a power supply plate connectable with the movable terminal and fixed terminal.

According to an aspect of the invention, the respective thermostats are arranged on the same line in a longitudinal direction of the heat roller.

According to an aspect of the invention, electrical junctions of each of the thermostats are spot-welded.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
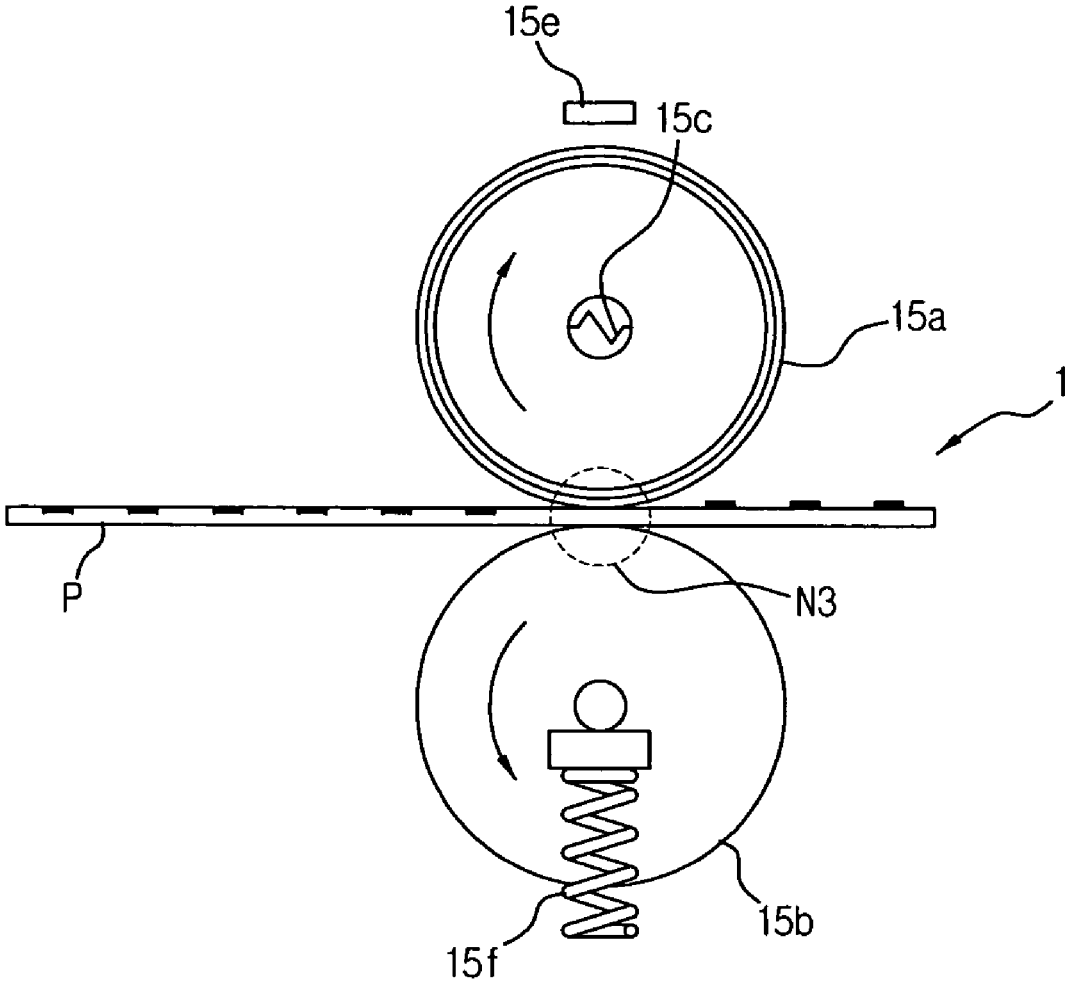
FIG. 1 (PRIOR ART)
FIG. 1 is a schematic view illustrating the configuration of a conventional image fixing apparatus.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
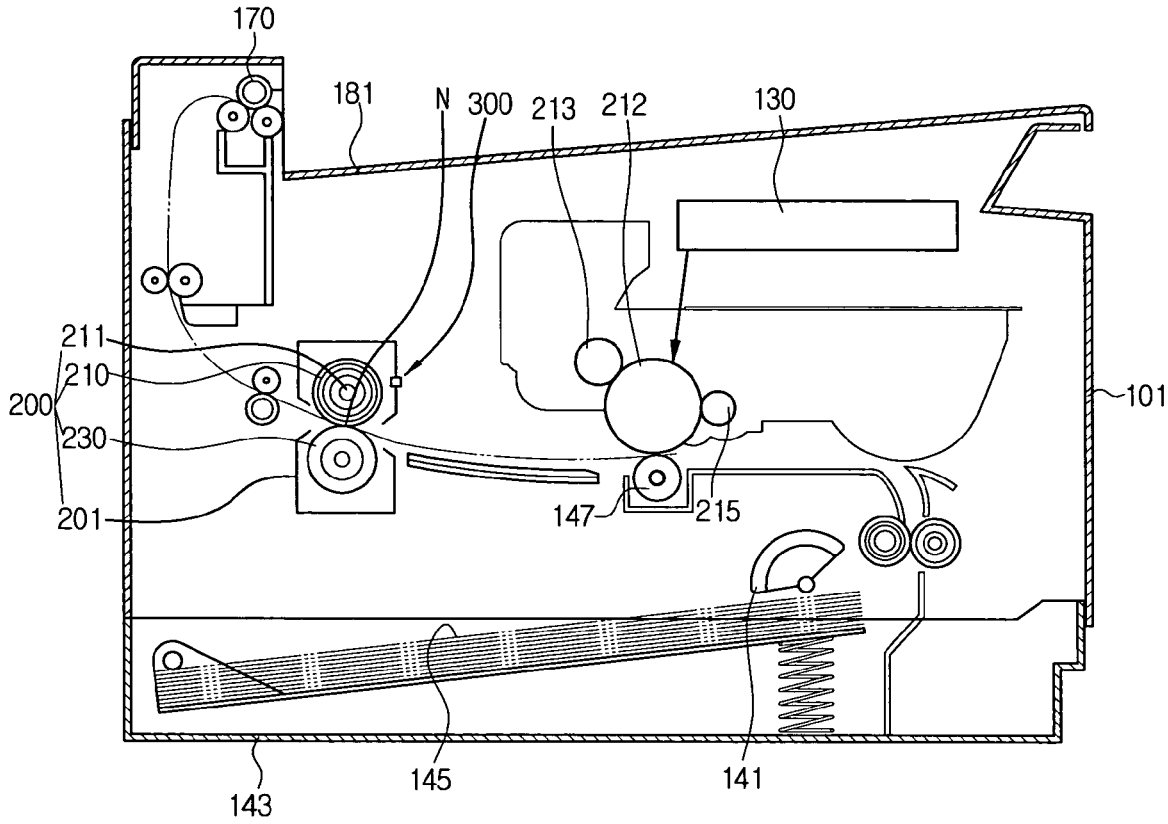
FIG. 2 is a schematic view illustrating an image forming apparatus using an image fixing apparatus according to an embodiment of the present invention.

FIG. 2 is a schematic view illustrating an image forming apparatus using an image fixing apparatus. Referring to FIG. 2, a photosensitive drum 212 is rotated in a predetermined direction. During this rotation, the photosensitive drum 212 is electrically charged with a predetermined polarity and voltage by a charge roller 213 of a charge unit. A predetermined beam, for example a laser beam, is scanned over the surface of the charged photosensitive drum 212, forming an electrostatic latent image on the surface thereof. The electrostatic latent image formed on the photosensitive drum 212 is developed with a developing material into a visual toner image by a developing roller 215 of a developing unit.

A sheet of recording media 145 (i.e., paper, transparency, etc.), loaded in a paper feeding cassette 143, is supplied as a result of a driving of a sheet supply roller 141 towards the photosensitive drum 212. As the recording medium 145 passes through a contact nip between the photosensitive drum 212 and a transferring roller 147, the toner image on the photosensitive drum 212 is gradually transferred onto a side of the recording medium 145. The recording medium 145, having the toner image transferred thereon, then passes through a fixing nip N between a heat roller 210 and a press roller 230 of the image fixing apparatus 200. As a result, the toner image is heat-fixed on the recording medium 145. After passing through the image fixing apparatus 200, the recording medium 145 is discharged through a paper discharge unit 170 to a paper discharge tray 181 arranged at an outer side of a main body 101 of the image forming apparatus.

Figure 3:
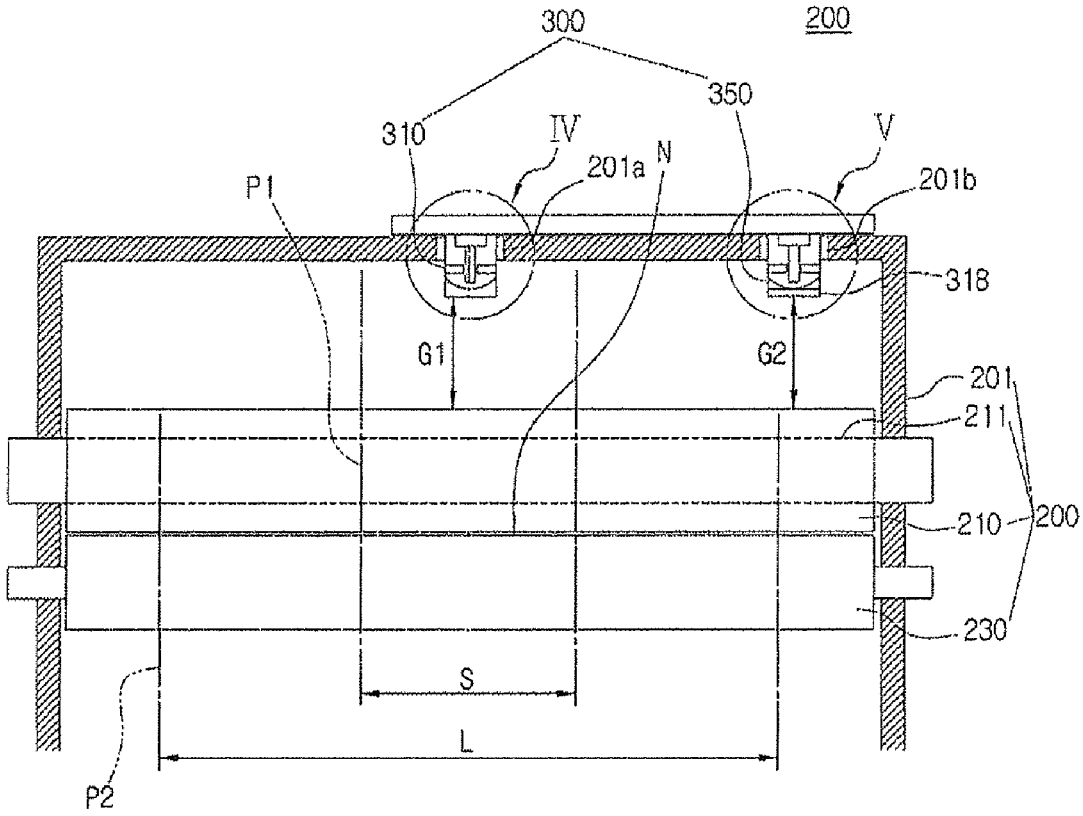
FIG. 3 is a schematic sectional view illustrating the configuration of the image fixing apparatus shown in FIG. 2.

FIG. 3 is a schematic sectional view illustrating a configuration of the image fixing apparatus 200. As shown in FIG. 3, the image fixing apparatus 200 comprises a fixing frame 201, in which the heat roller 210 is rotatably installed. A heating source 211 is embedded in the heat roller 210. The press roller 230 is installed close to the heat roller 210 and contacts the heat roller 210 at a predetermined pressurizing force to form the fixing nip N.

Two or more overheat prevention devices 300 are installed at a side of the fixing frame 201 to cut off the power supply to the heating source 211 when the temperature of the surface of the heat roller 210 rises out of a normal temperature range. The overheat prevention devices 300 may include, for example, thermostats. As for the thermostats, as shown in FIG. 3, they may include an inner thermostat 310, which is installed at a first site near to a portion of the heat roller 210 corresponding to a location within the width of a recording medium P1 or P2 passing through the fixing nip N, and an outer thermostat 350 which is installed at a second site near to an end portion of the heat roller 210 corresponding to a location outside the width of the recording media P1 or P2.

For referential purposes, in the drawings, reference symbols S and L denote widths of minimum-sized and maximum-sized recording media P1 and P2 that may pass through the fixing nip N, respectively. In consideration of these widths, the inner thermostat 310 should be installed at a first site near to a portion (i.e., a middle portion) of the heat roller 210 corresponding to a location within the width of the minimum-sized recording medium P1. Similarly, the outer thermostat 350 should be installed at a second site near to an end of the heat roller 210 corresponding to a location that is outside the width of the maximum-sized recording medium P2. Although it is illustrated in the drawings that the outer thermostat 350 is installed at a site near to the right end of the heat roller 210, the outer thermostat 350 may also be installed at a site near to the left end of the heat roller 210.

As is described above, two or more thermostats are employed in the present invention. That is, an inner thermostat 310 is installed at a site of the heat roller 210 corresponding to a location within the width of a minimum-sized recording medium P1 and an outer thermostat 350 is installed at a site of the heat roller 210 corresponding to a location outside the width of a maximum-sized recording medium P2. The reason for this configuration is to apply partially different overheat sensing functions to the heat roller 210 in consideration of temperature differences between a portion of the fixing nip N in contact with a recording medium P1 or P2 and another portion of the fixing nip N not in contact with a recording medium P1 or P2.

Figure 4:
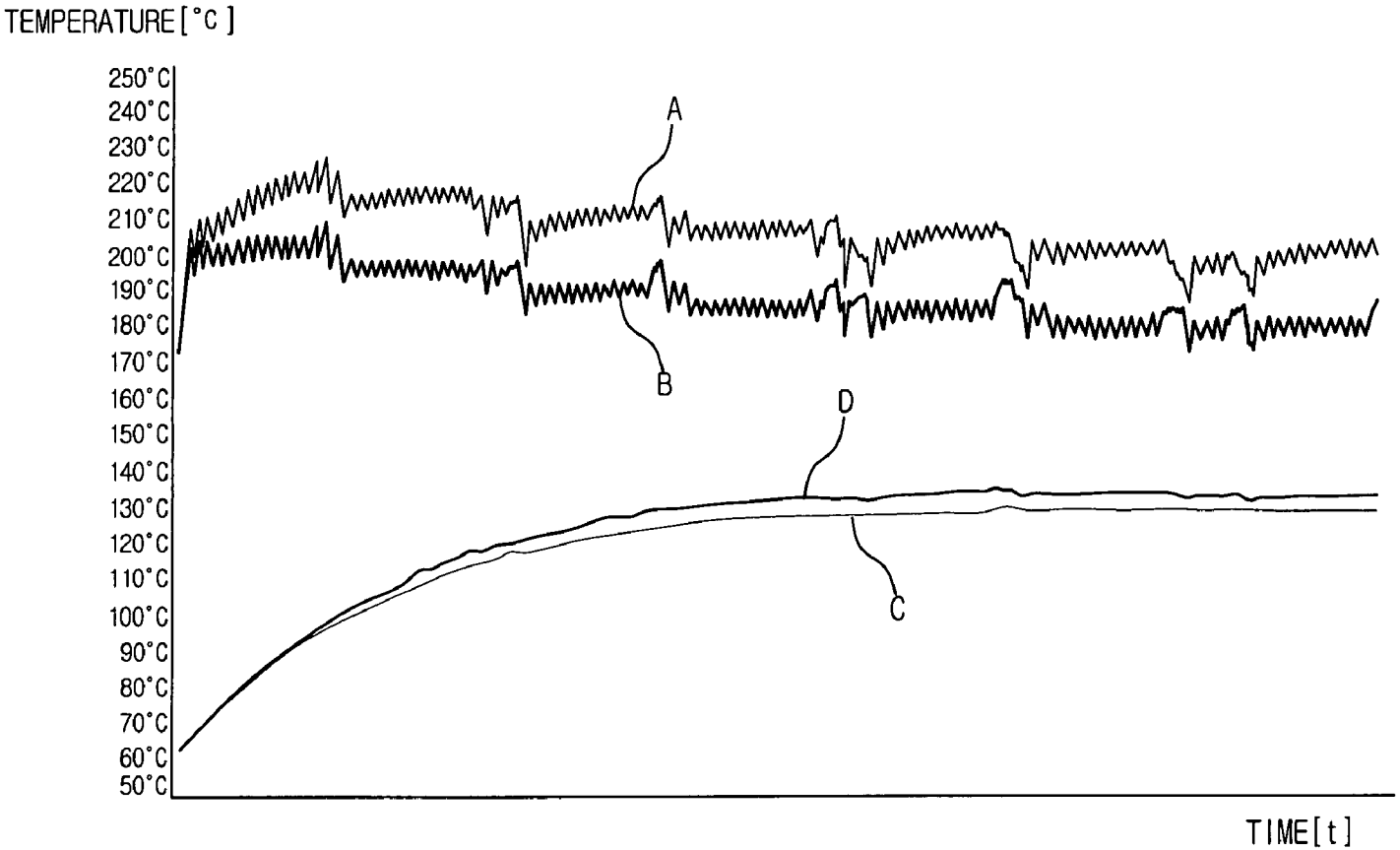
FIG. 4 is a graph showing temperatures measured at the surface of a heat roller and sites where inner and outer thermostats are installed, to aid understanding of an overheat prevention mechanism according to an embodiment of the present invention.

FIG. 4 is a graph showing temperatures measured at the surface of a heat roller and sites where inner and outer thermostats are installed, to aid in an understanding of an overheat prevention mechanism. As shown in FIG. 4, the horizontal axis denotes time, and the vertical axis denotes temperature in ° C. A waveform line A denotes temperatures ranging from 200 to 220° C. measured at an end, namely a portion of the heat roller 210 not in contact with a recording medium P1 or P2. A waveform line B denotes temperatures ranging from 180 to 206° C. measured at a middle of the heat roller and in particular, at a portion of the heat roller 210 in contact with a recording medium P1 or P2. A curved line C denotes temperature changes at a site where an inner thermostat 310 is installed near to the middle of the heat roller 210, and indicates a saturation temperature of 128° C. A curved line D denotes temperature changes at a site where an outer thermostat 350 is installed near to an end of the heat roller 210 not in contact with a recording medium, (i.e., paper, transparency etc.) P1 or P2, and indicates a saturation temperature of 132° C.

It may be understood from the above description that there exists a temperature difference of 10 to 20° C. between a portion of the surface of the heat roller 210 in contact with the recording medium P1 or P2 and another portion thereof not in contact with the recording medium P1 or P2. Thus, for more efficient overheat prevention, it is necessary to adequately adjust arrangement, operating temperatures and response times of the overheat prevention devices 300 in consideration of temperature differences in the heat roller 210.

Hereinafter, a more detailed description is given of examples concerning various changes and applications of thermostats in consideration of temperature differences in a fixing nip.

First Embodiment

In the first embodiment to cope with temperature differences in a fixing nip, as shown in FIG. 3, a gap G1 between an inner thermostat 310 and the surface of a heat roller 210 may be set equal to a gap G2 between an outer thermostat 350 and the surface of the heat roller 210, and a response time of the inner thermostat 310 may be set to be different from that of the outer thermostat 350.

Here, to set different response times, an open-type thermostat may be used for the inner thermostat 310, and a closed-type thermostat may be used for the outer thermostat 350.

Figure 5A:
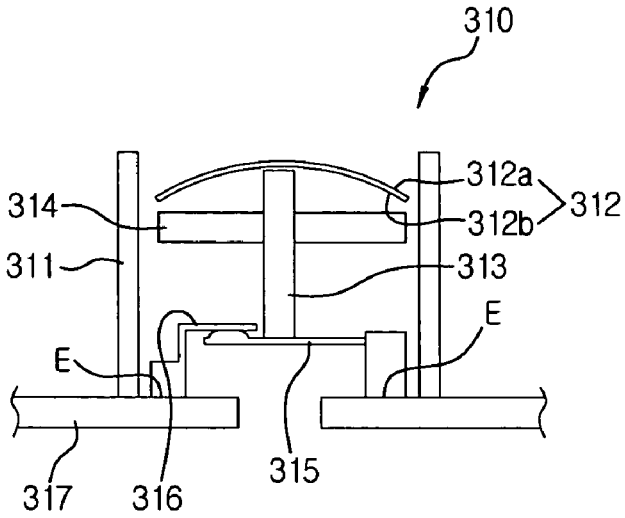
FIG. 5A is an enlarged view showing the configuration of an open type inner thermostat indicated by IV in FIG. 3.

FIG. 5A is an enlarged view showing the configuration of an open-type inner thermostat indicated by IV in FIG. 3. As shown in FIG. 5A, the open-type inner thermostat 310 comprises a housing 311, a bimetal 312 installed in the housing 311 to face the surface of the heat roller 210, an operating pin 313 to contact a surface of the bimetal 312, a guide plate 314 to guide a movement of the operating pin 313, a movable terminal 315 coupled with the movement of the operating pin 313, a fixed terminal 316 to selectively contact the movable terminal 315 in response to the movement of the operating pin 313, and a power supply plate 317 connectable with the movable terminal 315 and fixed terminal 316 to supply the electric power to a heating source 211. The end of the housing 311 facing the heat roller 210 is open. Thus, the bimetal 312 is able to rapidly respond to heat directly transferred from the surface of the heat roller 210. The bimetal 312 includes first and second metal layers 312*a* and 312*b* having different thermal expansion coefficients. The first metal layer 312*a* is made of, for example, an alloy of nickel-iron (Ni—Fe) having a small thermal expansion coefficient. The second metal layer 312*b* is made of, for example, an alloy of nickel-manganese-copper (Ni—Mn—Cu) or nickel-iron-copper (Ni—Fe—Cr) having a large thermal expansion coefficient. The operating pin 313 is made of a ceramic material.

Figure 5B:
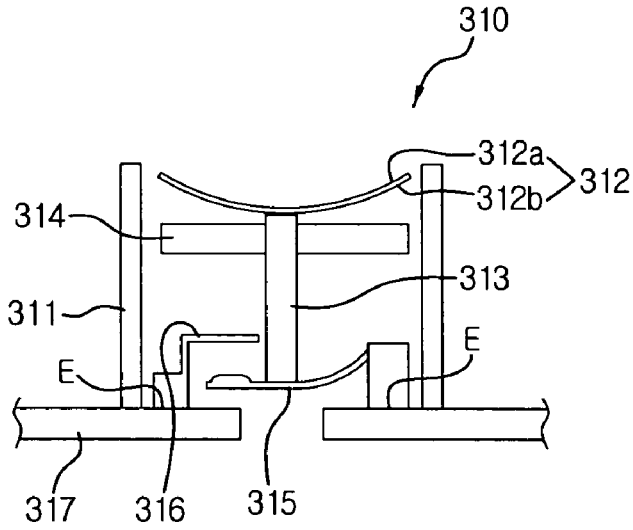
FIG. 5B is a view illustrating a state where the inner thermostat of FIG. 5A is operated to cut off the power supply to a heating source of the heat roller.

FIG. 5B is a view illustrating a state where the inner thermostat 310 of FIG. 5A is operated to cut off the power supply to the heating source 211 of the heat roller 210. As shown in FIG. 5B, when the surface temperature of the heat roller 210 is higher than normal, the second metal layer 312*b* of the bimetal 312 having a large thermal expansion coefficient expands above a critical level, thereby reversing the bending direction of the bimetal 312 towards the operating pin 313. The operating pin 313 is linearly moved to pressurize the movable terminal 315, which is then detached from the fixed terminal 316. Consequently, the power passing through the power supply plate 317 to the heating source 211 is cut off, thereby stopping a heating operation of the heating source 211 and preventing an overheating of the heat roller 210.

Figure 6:
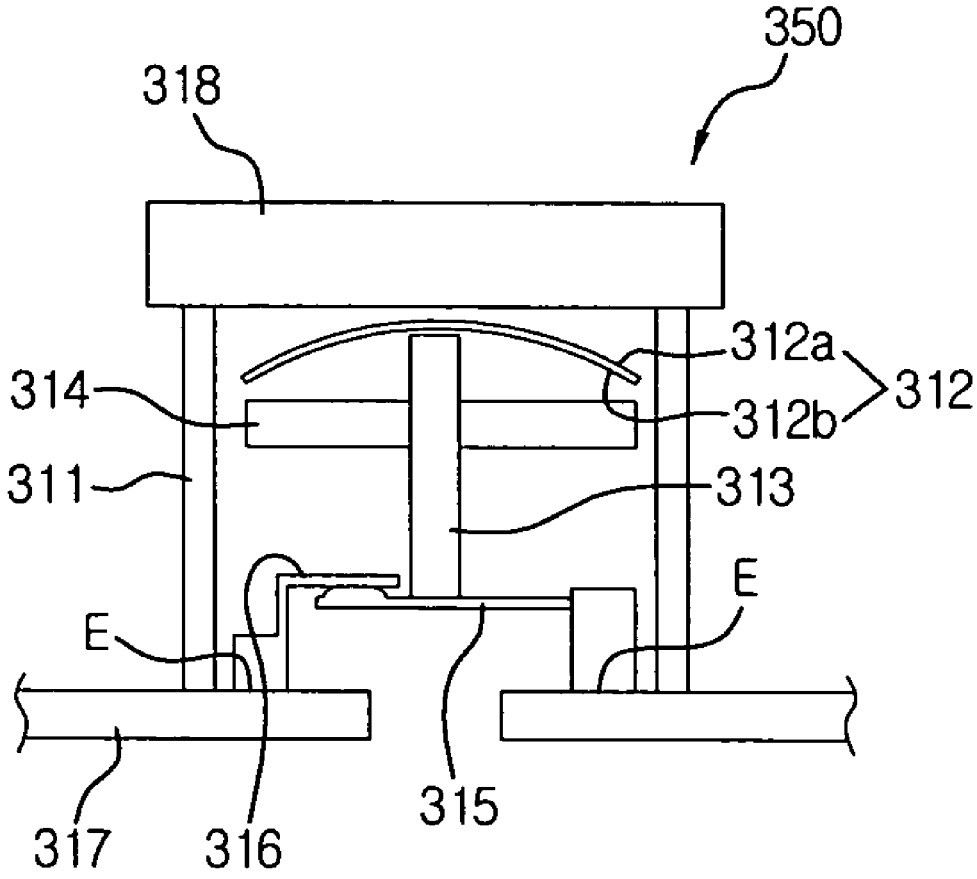
FIG. 6 is an enlarged view showing the configuration of a closed type thermostat indicated by V in FIG. 3.

FIG. 6 is an enlarged view showing the configuration of a closed-type outer thermostat indicated by V in FIG. 3. As such, most parts shown in FIG. 6 are the same as those of the open-type inner thermostat 310 in FIG. 5A. Therefore, the same elements are denoted by the same reference symbols, and a repeated description thereof will be omitted. The configuration of the closed-type outer thermostat 350 in FIG. 6 is the same as that of the open-type inner thermostat 310 in FIG. 5A, except that a cap 318 is provided to the end of the housing 311 facing the heat roller 210. The cap 318 may be made of, for example, aluminum, and acts to delay a response time of the closed-type outer thermostat 350 by shielding the bimetal 312 from heat directly transferred from the heat roller 210. The response time of the closed-type outer thermostat 350 is longer by about 10 seconds than that of the open-type inner thermostat 310. Accordingly, the outer thermostat 350 responds to temperature changes more slowly than the inner thermostat 310 for more effective overheat prevention in consideration of a temperature difference between a middle part of the heat roller 210 and an end part thereof.

Second Embodiment

Figure 7:
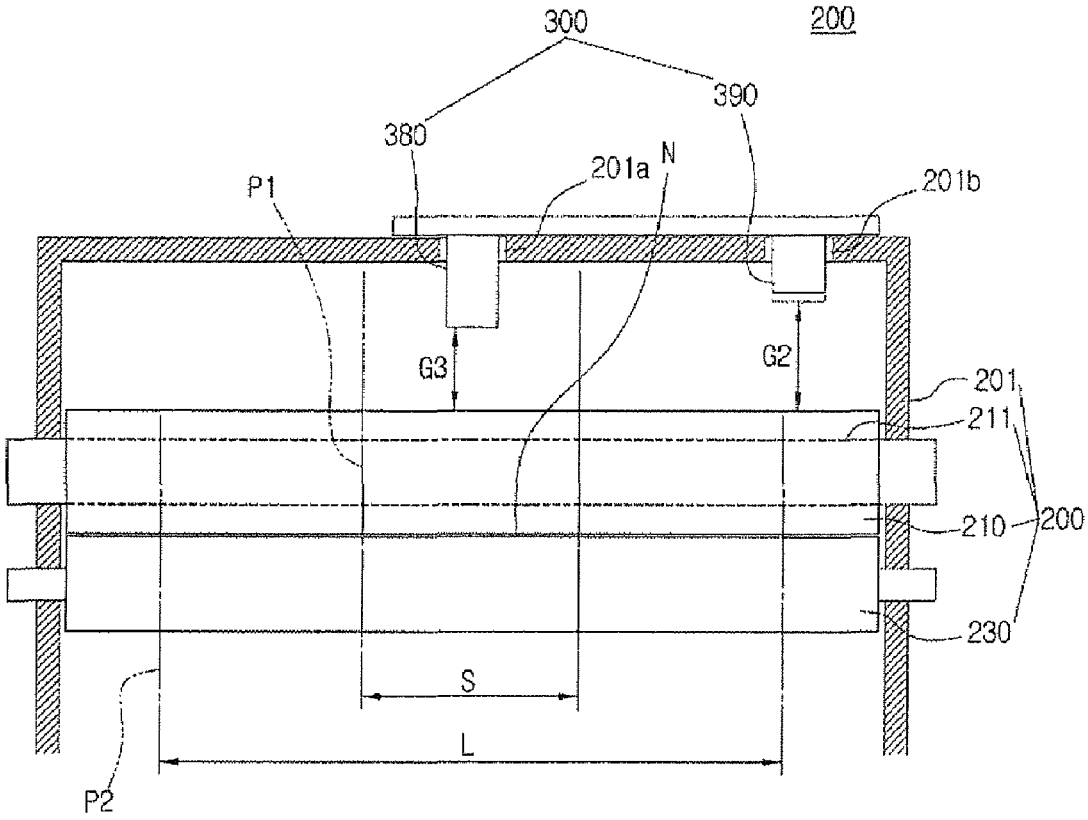
FIG. 7 is a schematic sectional view illustrating the configuration of an image fixing apparatus according to a third embodiment of the present invention.
Figure 8A:
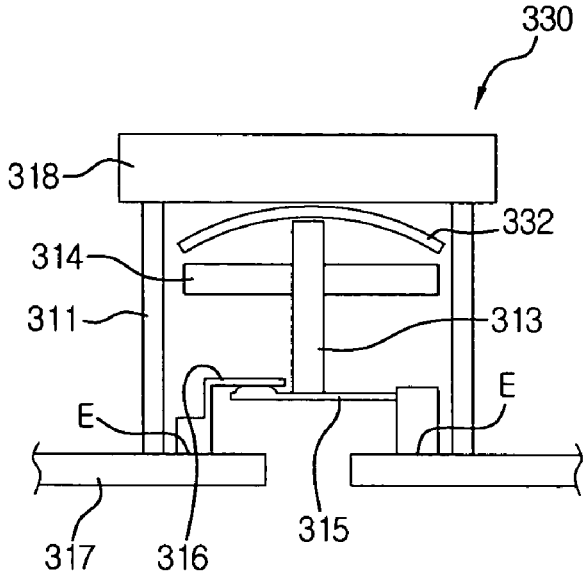
Figure 8B:
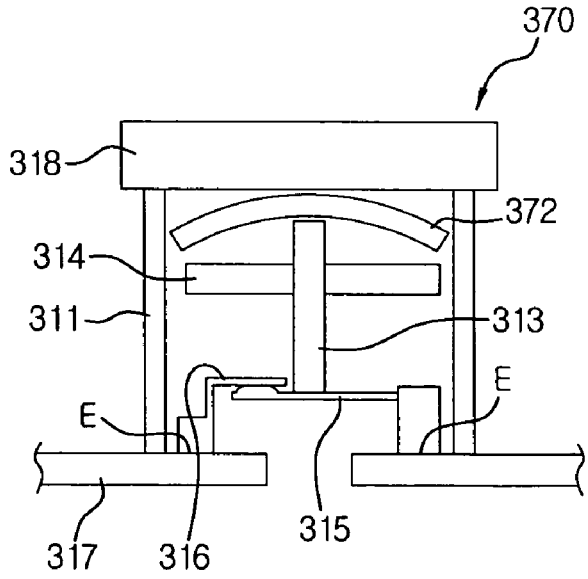
Figure 9:
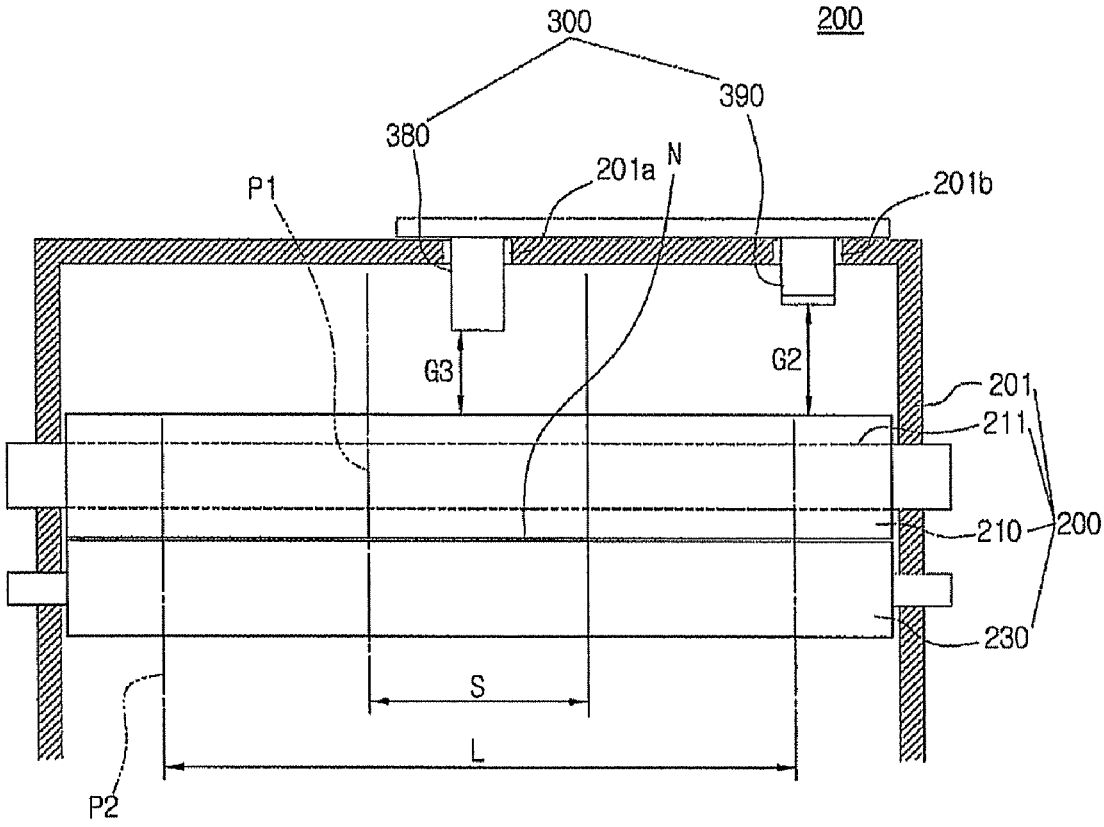

FIG. 7 is a schematic sectional view illustrating the configuration of an image fixing apparatus according to a third embodiment of the present invention. Referring to FIG. 7, a gap G3 between an inner thermostat 380 and the surface of the heat roller 210 may be set to be different from a gap G2 between an outer thermostat 390 and the surface of the heat roller 210, and a response time and operating temperature of the inner thermostat 380 may be set to be equal to those of the outer thermostat 390, respectively.

Here, the gap G3 is set to be narrower than the gap G2 to thereby substantially equalize the amount of heat transferred from the heat roller 210 to the inner thermostat 380 with the amount of heat transferred from the heat roller 210 to the outer thermostat 390.

The response time of the inner thermostat 380 may be set to be equal to that of the outer thermostat 390 by utilizing closed-type thermostats for both the inner thermostat 380 and the outer thermostat 390 or utilizing open-type thermostats for both the inner thermostat 380 and the outer thermostat 390.

The operating temperature of the inner thermostat 380 may be set to be equal to that of the outer thermostat 390 by utilizing thermostats of the same type (either open or closed) for both the inner thermostat 380 and outer thermostat 390, and by imposing the same conditions upon the bimetals 332 and 372 of the inner thermostat 380 and outer thermostat 390, respectively.

In addition, the inner thermostat 310, 330 or 380 and the outer thermostat 350, 370 or 390 are inserted into through-holes 201*a* and 201*b* of the fixing frame 201, respectively, and are arranged on the same line in a longitudinal direction of the heat roller 210 (FIGS. 3, and 7).

In the inner thermostat 310, 330 or 380 and the outer thermostat 350, 370 or 390, electrical junctions E, where, for example, the movable terminal 315, fixed terminal 316 and power supply plate 317 are interconnected, are spot-welded to facilitate heat conduction and to minimize heat losses and junction resistance (FIGS. 5A, and 6).

As is apparent from the above description, aspects of the present invention provide an image fixing apparatus wherein a prevention of overheating is performed in consideration of a temperature difference between a portion of a heat roller in contact with recording media and another portion thereof not in contact with the recording media.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An image forming apparatus, comprising:

a heat roller in which a heating source is embedded;

a press roller installed close to the heat roller, the press roller contacting the heat roller with a predetermined pressurizing force to form a fixing nip; and at least two overheat prevention devices installed near the heat roller to cut off a power supply to the heating source upon an overheating of the heat roller, wherein the at least two overheat prevention devices operate at different temperatures.

2. The image forming apparatus of claim 1, wherein gaps between the respective overheat prevention devices and a surface of the heat roller are set to be substantially equal to one another, and response times of the respective overheat prevention devices are set to be different from one another.

3. The image forming apparatus of claim 1, wherein gaps between the respective overheat prevention devices and a surface of the heat roller are set to be different from one another, and response times of the respective overheat prevention devices are set to be equal to one another.

4. The image forming apparatus of claim 3, wherein the gap between the one overheat prevention device and the surface of the heat roller is narrower than that between the another overheat prevention device and the surface of the heat roller.

5. The image forming apparatus of claim 1, wherein the different temperatures comprises a temperature of a surface of the heat roller.

6. An image forming apparatus, comprising:

a heat roller in which a heating source is embedded;

a press roller installed close to the heat roller, the press roller contacting the heat roller with a predetermined pressurizing force to form a fixing nip; and at least two overheat prevention devices installed near the heat roller to cut off a power supply to the heating source upon an overheating of the heat roller, wherein gaps between the respective overheat prevention devices and a surface of the heat roller are set to be different from one another, and operating temperatures of the respective overheat prevention devices are set to be substantially equal to one another.

7. The image forming apparatus of claim 6, wherein the gap between the one overheat prevention devices and the surface of the heat roller is narrower than that between the another overheat prevention device and the surface of the heat roller.

8. An image forming apparatus, comprising:

a heat roller in which a heating source powered by a power supply is embedded;

a press roller installed close to the heat roller, the press roller contacting the heat roller with a predetermined pressurizing force to form a fixing nip; and at least one thermostat installed at a first site near a portion of the heat roller corresponding to a location within a width of a recording medium passing through the fixing nip and another thermostat installed at a second site near to an end of the heat roller corresponding to another location outside the width of the recording medium, wherein:

gaps between the respective thermostats and a surface of the heat roller are set to be equal to another while response times of the respective thermostats are set to be different from one another, or the gaps between the respective thermostats and the surface of the heat roller are set to be different from one another while the response times of the respective thermostats are set to be equal to one another and/or the operating temperatures of the respective thermostats are set to be equal to one another.

9. The image forming apparatus of claim 8, wherein the gaps between the respective thermostats and the surface of the heat roller are set to be equal to one another, and the response times of the respective thermostats are set to be different from one another.

10. The image forming apparatus of claim 9, wherein:

the one thermostat being an inner thermostat is an open-type, and comprises a housing, a bimetal installed in the housing so as to face the surface of the heat roller, an operating pin to contact a surface of the bimetal, a guide plate to guide movement of the operating pin, a movable terminal coupled with the movement of the operating pin, a fixed terminal to selectively contact the movable terminal depending upon the movement of the operating pin, and a power supply plate connectable with the movable terminal and fixed terminal;

the another thermostat being an outer thermostat is a closed-type, and comprises a housing, a bimetal installed in the housing so as to face the surface of the heat roller, an operating pin to contact a surface of the bimetal, a guide plate to guide movement of the operating pin, a movable terminal coupled with the movement of the operating pin, a fixed terminal to selectively contact the movable terminal depending upon the movement of the operating pin, a power supply plate connectable with the movable terminal and fixed terminal, and a cap installed at an end of the housing facing the heat roller; and the response times of the inner and outer thermostats are set to be different from each other.

11. The image forming apparatus of claim 8, wherein the gaps between the respective thermostats and the surface of the heat roller are set to be different from one another, and the response times of the respective thermostats are set to be equal to one another.

12. The image forming apparatus of claim 11, wherein the gap between the one thermostat being an inner thermostat and the surface of the heat roller is set to be narrower than that between the another thermostat being an outer thermostat and the surface of the heat roller.

13. The image forming apparatus of claim 12, wherein each of the inner and outer thermostats is a closed-type, and comprises a housing, a bimetal installed in the housing so as to face the surface of the heat roller, an operating pin to contact a surface of the bimetal, a guide plate to guide movement of the operating pin, a movable terminal coupled with the movement of the operating pin, a fixed terminal to selectively contact the movable terminal depending upon the movement of the operating pin, a power supply plate connectable with the movable terminal and fixed terminal, and a cap installed at an end of the housing facing the heat roller.

14. The image forming apparatus of claim 12, wherein each of the inner and outer thermostats is an open-type, and comprises a housing, a bimetal installed in the housing so as to face the surface of the heat roller, an operating pin to contact a surface of the bimetal, a guide plate to guide movement of the operating pin, a movable terminal coupled with the movement of the operating pin, a fixed terminal to selectively contact the movable terminal depending upon the movement of the operating pin, and a power supply plate connectable with the movable terminal and fixed terminal.

15. The image forming apparatus of claim 8, wherein the gaps between the respective thermostats and the surface of the heat roller are set to be different from one another, and the operating temperatures of the respective thermostats are set to be equal to one another.

16. The image forming apparatus of claim 15, wherein the gap between the one thermostat being an inner thermostat and the surface of the heat roller is set to be narrower than that between the another thermostat being an outer thermostat and the surface of the heat roller.

17. The image forming apparatus of claim 16, wherein each of the inner and outer thermostats is a closed-type, and comprises a housing, a bimetal installed in the housing so as to face the surface of the heat roller, an operating pin to contact a surface of the bimetal, a guide plate to guide movement of the operating pin, a movable terminal coupled with the movement of the operating pin, a fixed terminal to selectively contact the movable terminal depending upon the movement of the operating pin, a power supply plate connectable with the movable terminal and fixed terminal, and a cap installed at an end of the housing facing the heat roller.

18. The image forming apparatus of claim 16, wherein each of the inner and outer thermostats is an open-type, and comprises a housing, a bimetal installed in the housing so as to face the surface of the heat roller, an operating pin to contact a surface of the bimetal, a guide plate to guide movement of the operating pin, a movable terminal coupled with the movement of the operating pin, a fixed terminal to selectively contact the movable terminal depending upon the movement of the operating pin, and a power supply plate connectable with the movable terminal and fixed terminal.

19. The image forming apparatus of claim 8, wherein the respective thermostats are arranged on the same line in a longitudinal direction of the heat roller.

20. The image forming apparatus of claim 8, wherein electrical junctions of each of the thermostats are spot-welded.

21. An image forming apparatus, comprising:

a heat roller in which a heating source powered by a power supply is embedded;

a press roller installed close to the heat roller, the press roller contacting the heat roller with a predetermined pressurizing force to form a fixing nip between the heat roller and the press roller;

at least one first thermostat installed at a first site near a portion of the heat roller corresponding to a location within a width of a recording medium passing through the fixing nip and at least one second thermostat installed at a second site near to an end of the heat roller corresponding to another location outside the width of the recording medium;

overheat prevention devices, each associated with a corresponding thermostat, to cut off the power supply to the heating source upon a detection of an overheating of the heat roller by the thermostats, wherein:

gaps between the respective thermostats and a surface of the heat roller are set to be equal to another while response times of the at least one first thermostats and the at least one second thermostats are set to be different from one another, or the gaps between the at least one first thermostats and the surface of the heat roller and between the at least one second thermostats and the surface of the heat roller are set to be different from one another while the response times of the respective thermostats are set to be equal to one another and/or the operating temperatures of the respective thermostats are set to be equal to one another.

* * * * *